US006220632B1

(12) United States Patent
Rosebush

(10) Patent No.: US 6,220,632 B1
(45) Date of Patent: Apr. 24, 2001

(54) BINDER DEVICE

(76) Inventor: John C. Rosebush, #103-2983 W 4th Ave, Vancouver, BC (CA), V6K 1R5

( * ) Notice: Subject to any disclaimer, the term of this patent is extended or adjusted under 35 U.S.C. 154(b) by 0 days.

(21) Appl. No.: 09/602,043

(22) Filed: Jun. 23, 2000

(51) Int. Cl.[7] ..... B42D 3/00

(52) U.S. Cl. ..... 281/29; 281/37; 281/21.1; 402/70; 402/73

(58) Field of Search ..... 402/79, 658, 80 R, 402/80 L, 80 P, 4; 281/21.1, 15.1, 28, 36, 37, 38, 51

(56) References Cited

U.S. PATENT DOCUMENTS 5,848,851 * 12/1998 Gunasekera ..... 402/79
6,045,285 * 4/2000 Friedman ..... 402/79
6,089,607 * 7/2000 Keeney et al. ..... 402/79 X

* cited by examiner

*Primary Examiner*—Willmon Fridie, Jr.

(57) ABSTRACT

A binder device for holding and protecting papers while having elastic hinges for the addition of additional dividers. The binder device includes a plurality of plates. Each of the plates has a top edge, a bottom edge, a front edge and a back edge. A coupling means removably couples a plurality of plates together. The coupling means includes a plurality of pairs of slots in the plates. Each of the pairs of slots extends into the back edge of the plates. A plurality of binding members removably binds the plates together. Each of the binding members forms a loop. One of the loops is placed in a pair of slots in a first plate and in a corresponding pair of slots in a second plate such that the first and second plates are hingedly coupled together.

6 Claims, 3 Drawing Sheets

BINDER DEVICE

BACKGROUND OF THE INVENTION

1. Field of the Invention

The present invention relates to binders for holding papers and more particularly pertains to a new binder device for holding and protecting papers while having elastic hinges for the addition of additional dividers.

2. Description of the Prior Art

The use of binders for holding papers is known in the prior art. More specifically, binders for holding papers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,236,226; U.S. Pat. No. 730,727; U.S. Pat. No. 4,014,508; U.S. Pat. No. 5,456,497; U.S. Des. Pat. No. 374,037; and U.S. Des. Pat. No. 364,640.

While these devices fulfill their respective, particular objectives and requirements, the aforementioned patents do not disclose a new binder device. The inventive device includes a plurality of plates. Each of the plates has a top edge, a bottom edge, a front edge and a back edge. A coupling means removably couples a plurality of plates together. The coupling means includes a plurality of pairs of slots in the plates. Each of the pairs of slots extends into the back edge of the plates. A plurality of binding members removably binds the plates together. Each of the binding members forms a loop. One of the loops is placed in a pair of slots in a first plate and in a corresponding pair of slots in a second plate such that the first and second plates are hingedly coupled together.

In these respects, the binder device according to the present invention substantially departs from the conventional concepts and designs of the prior art, and in so doing provides an apparatus primarily developed for the purpose of holding and protecting papers while having elastic hinges for the addition of additional dividers.

SUMMARY OF THE INVENTION

In view of the foregoing disadvantages inherent in the known types of binders for holding papers now present in the prior art, the present invention provides a new binder device construction wherein the same can be utilized for holding and protecting papers while having elastic hinges for the addition of additional dividers.

The general purpose of the present invention, which will be described subsequently in greater detail, is to provide a new binder device apparatus and method which has many of the advantages of the binders for holding papers mentioned heretofore and many novel features that result in a new binder device which is not anticipated, rendered obvious, suggested, or even implied by any of the prior art binders for holding papers, either alone or in any combination thereof.

To attain this, the present invention generally comprises a plurality of plates. Each of the plates has a top edge, a bottom edge, a front edge and a back edge. A coupling means removably couples a plurality of plates together. The coupling means includes a plurality of pairs of slots in the plates. Each of the pairs of slots extends into the back edge of the plates. A plurality of binding members removably binds the plates together. Each of the binding members forms a loop. One of the loops is placed in a pair of slots in a first plate and in a corresponding pair of slots in a second plate such that the first and second plates are hingedly coupled together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new binder device apparatus and method which has many of the advantages of the binders for holding papers mentioned heretofore and many novel features that result in a new binder device which is not anticipated, rendered obvious, suggested, or even implied by any of the prior art binders for holding papers, either alone or in any combination thereof.

It is another object of the present invention to provide a new binder device which may be easily and efficiently manufactured and marketed.

It is a further object of the present invention to provide a new binder device which is of a durable and reliable construction.

An even further object of the present invention is to provide a new binder device which is susceptible of a low cost of manufacture with regard to both materials and labor, and which accordingly is then susceptible of low prices of sale to the consuming public, thereby making such binder device economically available to the buying public.

Still yet another object of the present invention is to provide a new binder device which provides in the apparatuses and methods of the prior art some of the advantages thereof, while simultaneously overcoming some of the disadvantages normally associated therewith.

Still another object of the present invention is to provide a new binder device for holding and protecting papers while having elastic hinges for the addition of additional dividers.

Yet another object of the present invention is to provide a new binder device which includes a plurality of plates. Each of the plates has a top edge, a bottom edge, a front edge and a back edge. A coupling means removably couples a plurality of plates together. The coupling means includes a plurality of pairs of slots in the plates. Each of the pairs of slots extends into the back edge of the plates. A plurality of binding members removably binds the plates together. Each of the binding members forms a loop. One of the loops is placed in a pair of slots in a first plate and in a corresponding pair of slots in a second plate such that the first and second plates are hingedly coupled together.

Still yet another object of the present invention is to provide a new binder device that has first and second outside plates wherein additional plates, or dividers may be added between the first and second plates.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
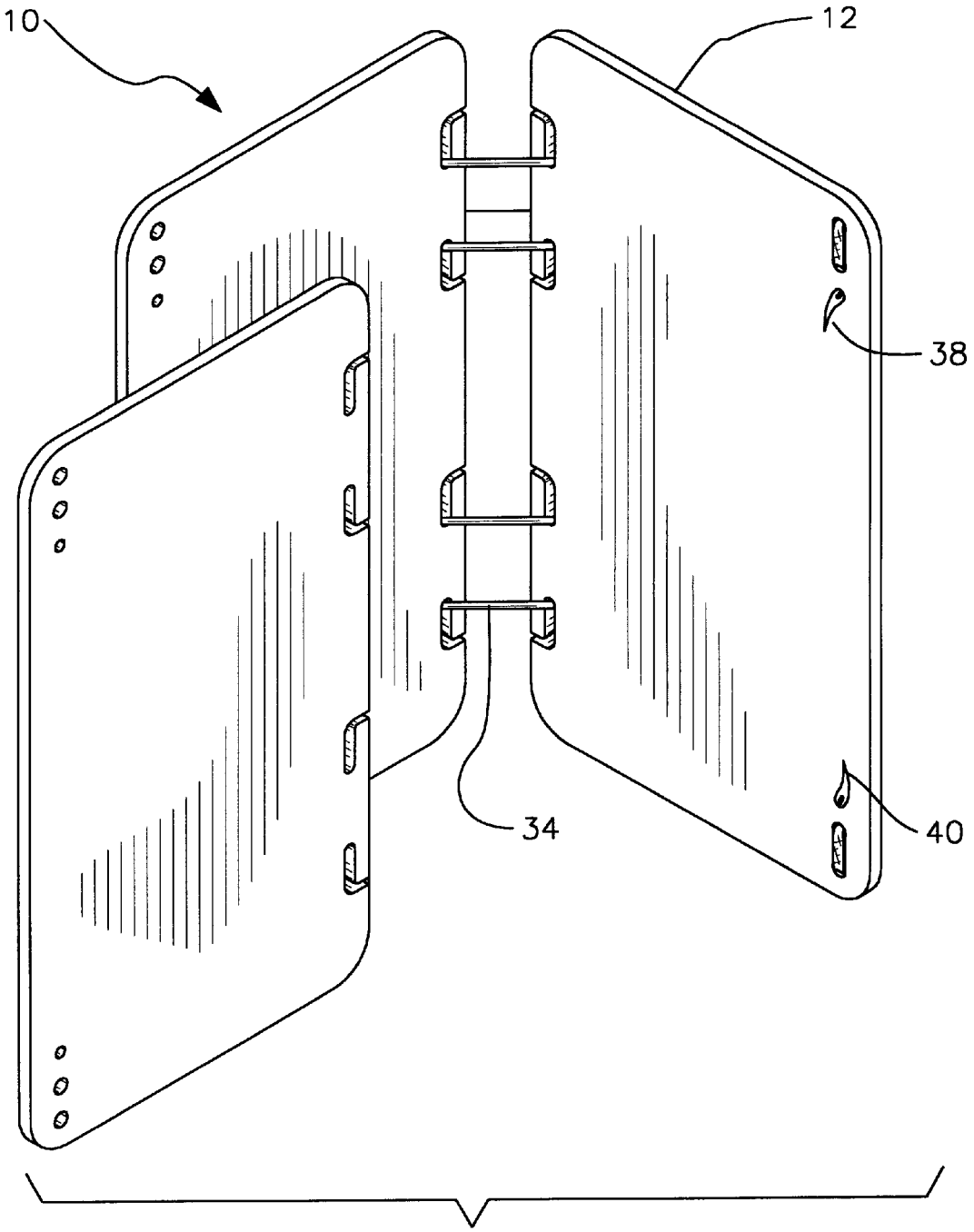
FIG. 1 is a schematic perspective view of a new binder device according to the present invention.
Figure 2:
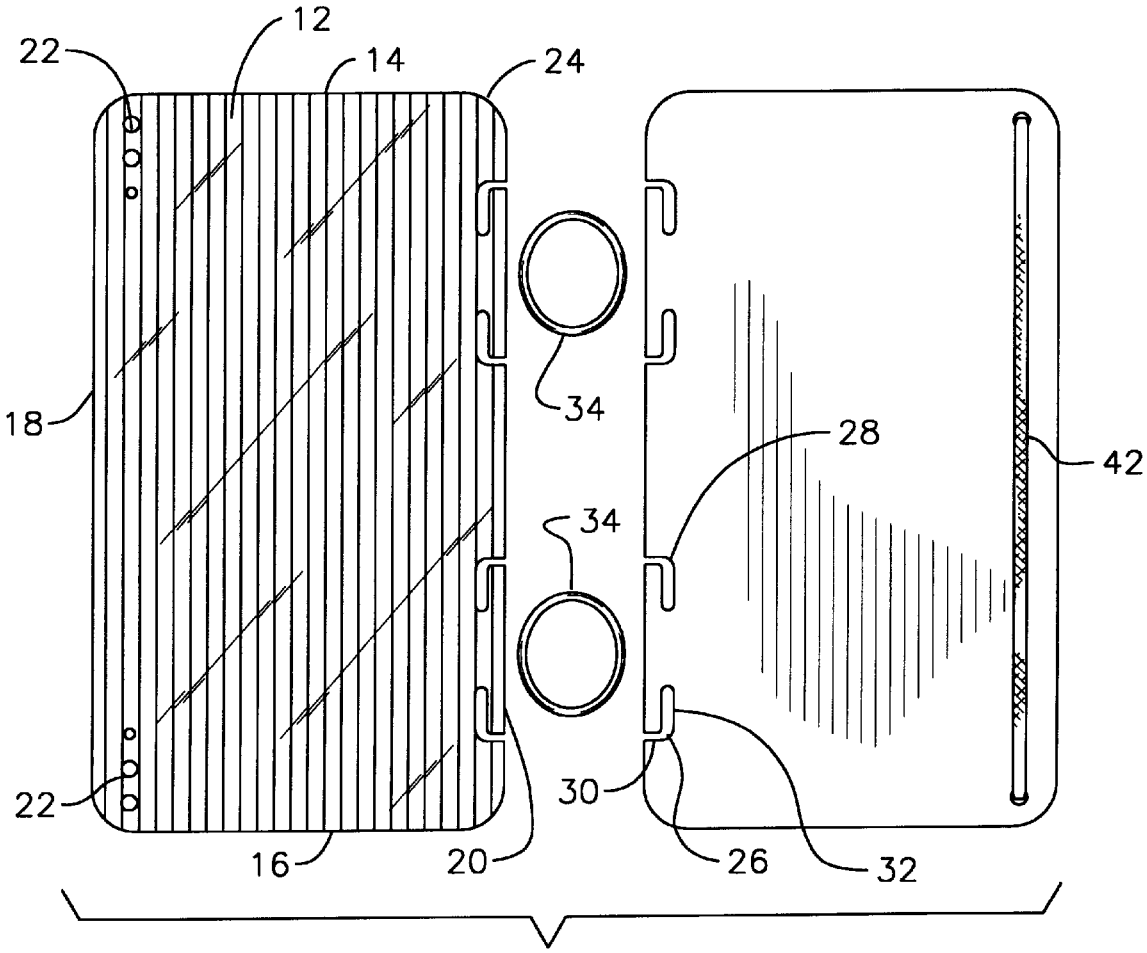
FIG. 2 is a schematic plan view of the present invention.
Figure 3:
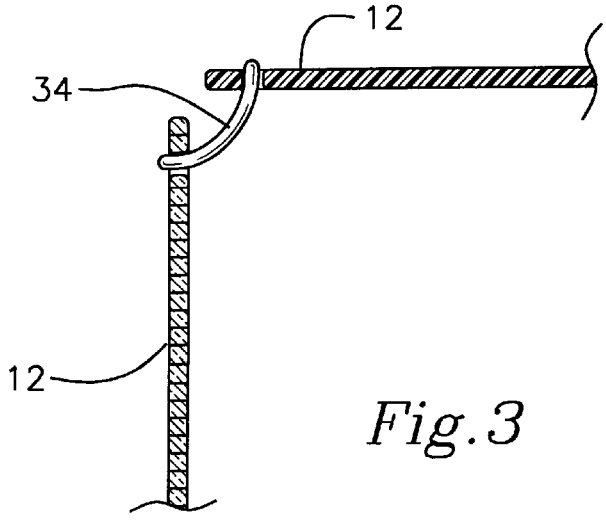
FIG. 3 is a schematic cross-sectional top view of the present invention.

With reference now to the drawings, and in particular to FIGS. 1 through 5 thereof, a new binder device embodying the principles and concepts of the present invention and generally designated by the reference numeral 10 will be described.

As best illustrated in FIGS. 1 through 5, the binder device 10 generally comprises a plurality of plates 12. Each of the plates 12 has a top edge 14, a bottom edge 16, a front edge 18 and a back edge 20. A plurality of apertures 22 is in each plate 12. Each of the apertures 22 is generally positioned adjacent to the front edge 18 of the plates 12. Preferably, three apertures 22 are positioned nearer the top edge 14 than the bottom edge 16, and three apertures 22 are positioned nearer the bottom edge 16 than the top edge 14. Each of the plates 12 has a generally rectangular shape. Preferably each of the plates 12 has rounded corners 24. Each of the plates 12 preferably comprises a material selected from the group comprising metal, plastic, vinyl, cardboard and wood. The plates 12 can also be transparent for easy identification of the top document.

Figure 4:
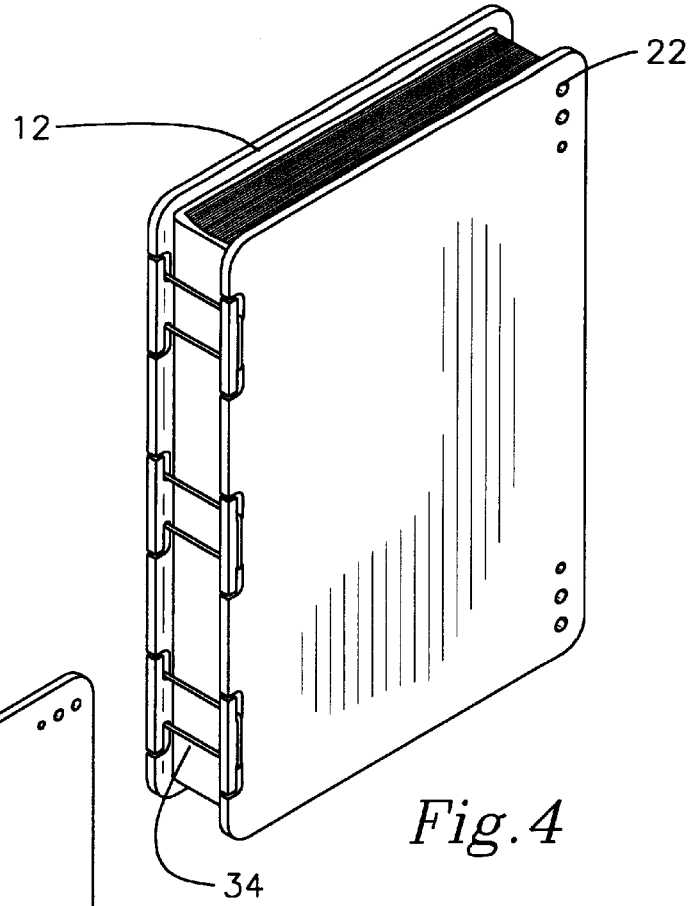
FIG. 4 is a schematic perspective view of the present invention.
Figure 5:
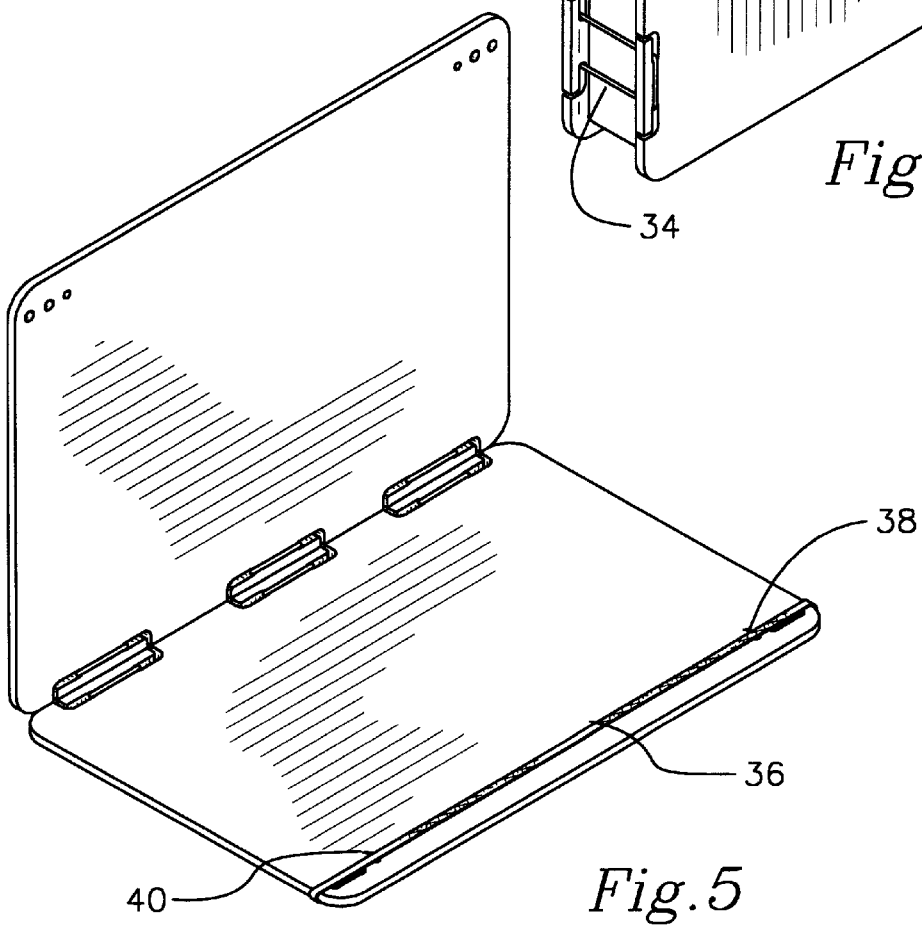
FIG. 5 is a schematic perspective view of the present invention.

A coupling means removably couples a plurality of plates together. The coupling means includes a plurality of pairs of slots in each of the plates 12. Each of the pairs of slots extends into the back edge 20 of the plates 12. Each of the pairs of slots comprises a first slot 26 and a second slot 28. The slots 26, 28 generally have an L-shape, wherein each of the slots has a foot portion 30 and a leg portion 32. The foot portions 30 extend into the back edge 20 such that the leg portions 32 are orientated generally perpendicular to the back edge 20. The leg portions 32 of the first 26 and second 28 slots extend toward each other. The plates 12 in FIG. 1 show two pairs of slots and FIGS. 4 and 5 show three pairs of slots. The number of slots depends on the size of the plates 12, which may come in any size depending on what they are protecting.

A plurality of binding members 34 removably binds the plates 12 together. Each of the binding members 34 forms a loop. One of the loops is placed in the leg portions 32 of a pair of slots 28, 30 in a first plate and in a corresponding pair of slots 28, 30 in a second plate such that the first and second plates are hingedly coupled together as depicted in FIG. 1. Binding members 34 may be placed in all of the pairs of slots. Ideally, each of the binding members 34 comprises an elastic band. A plurality of plates 12 may be added between the first and second plates as is shown in FIG. 1. Also, additional plates may be added outside of the first and second plates. This may be accomplished by adding additional binding members since the slots are large enough to hold multiple binding members.

A securing means releasably secures the plates in a closed position. The securing means is an elongate flexible member 36 having a first end 38 and a second end 40. The first end 38 extends through a plurality of the apertures 22 in the second plate generally adjacent to the top edge 14. The second end 40 extends through a plurality of the apertures in the second plate generally adjacent to the bottom edge 16. The second plate may be any of the plates. A central portion 42 of the elongate flexible member 36 may be wrapped about the first plate. The elongate flexible member 36 ideally comprises an elastic material.

In use, plates 12 are chosen which have a size corresponding to the book, paper, blue prints or whatever item is being protected. The binding members 34 are placed about the slots of a first and second plate. If dividers are needed between pages being protected, additional plates 12 may be added as shown in FIG. 1. The securing means 36 may be wrapped about the first plate to bias it toward the second plate. Another embodiment, not shown, would utilize a central plate which would be larger than adjacent plates such that it extends beyond the adjacent plates. This extending portion may have a handle cut therein for ease of carrying the device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A binder device for protecting documents, said binder device comprising:

a plurality of plates, each of said plates having a top edge, a bottom edge, a front edge and a back edge;

a coupling means for removably coupling a plurality of plates together, said coupling means comprising:

each of said plates having a plurality of pairs of slots therein, each of said slots opening into said back edge of said plate;

a plurality of binding members for removably binding said plates together, each of said binding members forming a loop, wherein one of said loops is placed in a pair of slots in a first plate and in a corresponding pair of slots in a second plate such that said first and second plates are hingedly coupled together.

2. The binder device as in claim 1, further comprising:

a plurality of apertures being in each plate, each of said apertures being generally positioned adjacent to said front edge of said plates, wherein a securing means for securing a plurality of plates together may be strung through said apertures in said plates.

3. The binder device as in claim 1, wherein said plurality of apertures comprises:

three of said apertures being positioned nearer said top edge than said bottom edge, three of said apertures being positioned nearer said bottom edge than said top edge.

4. The binder device as in claim 3, wherein said securing means comprises:

said securing means being an elongate flexible member, said elongate flexible member having a first end and a second end, said first end extending through a plurality of said apertures in a second plate generally adjacent to said top edge, said second end extending through a plurality of said apertures in said second plate generally adjacent to said bottom edge, wherein a central portion of said elongate flexible member may be wrapped about a first plate.

5. The binder device as in claim 1, wherein each of said pairs of slots comprises:

a first slot and a second slot, each of said slots generally having an L-shape, wherein each of said slots have a foot portion and a leg portion, said foot portions opening into said back edge such that said leg portions are orientated generally perpendicular to said back edge, said leg portions of said first and second slots extending toward each other.

6. A binder device for protecting documents, said binder device comprising:

a plurality of plates, each of said plates having a top edge, a bottom edge, a front edge and a back edge, a plurality of apertures being in each plate, each of said apertures being generally positioned adjacent to said front edge of said plates, three of said apertures being positioned nearer said top edge than said bottom edge, three of said apertures being positioned nearer said bottom edge than said top edge, each of said plates having a generally rectangular shape, each of said plates having rounded corners, each of said plates comprising a material being selected from the group comprising metal, plastic, vinyl, cardboard and wood;

a coupling means for removably coupling a plurality of plates together, said coupling means comprising:

each of said plates having a plurality of pairs of slots therein, each of said pairs of slots extending into said back edge of said plates, each of said slots opening into said back edge of said plate, each slot of said pairs of slots comprising:

a first slot and a second slot, each of said slots generally having an L-shape, wherein each of said slots have a foot portion and a leg portion, said foot portions opening into said back edge such that said leg portions are orientated generally perpendicular to said back edge, said leg portions of said first and second slots extending toward each other;

a plurality of binding members for removably binding said plates together, each of said binding members forming a loop, wherein one of said loops is placed in the leg portions of a pair of slots in a first plate and in a corresponding pair of slots in a second plate such that said first and second plates are hingedly coupled together, wherein binding members may be placed in all of said pairs of slots, each of said binding members comprising an elastic band;

wherein a plurality of plates may be added between said first and second plates; and a securing means for releasably securing said plates, said securing means being an elongate flexible member, said elongate flexible member having a first end and a second end, said first end extending through a plurality of said apertures in said second plate generally adjacent to said top edge, said second end extending through a plurality of said apertures in said second plate generally adjacent to said bottom edge, wherein a central portion of said elongate flexible member may be wrapped about said first plate, said elongate flexible member comprising an elastic material.

* * * * *